US012779308B2

(12) United States Patent
DeLaby

(10) Patent No.: US 12,779,308 B2
(45) Date of Patent: Nov. 3, 2026

(54) GOLF CLUB SLEEVE ASSEMBLY AND METHODS OF USE

(71) Applicant: Jim DeLaby, Nipomo, CA (US)

(72) Inventor: Jim DeLaby, Nipomo, CA (US)

( * ) Notice: Subject to any disclaimer, the term of this patent is extended or adjusted under 35 U.S.C. 154(b) by 88 days.

(21) Appl. No.: 19/094,070

(22) Filed: Mar. 28, 2025

(65) Prior Publication Data

US 2025/0303257 A1 Oct. 2, 2025

Related U.S. Application Data

(60) Provisional application No. 63/571,807, filed on Mar. 29, 2024.

(51) Int. Cl.

| | |
|---|---|
| ***A63B 69/36*** | (2006.01) |
| ***A63B 60/12*** | (2015.01) |
| ***A63B 60/14*** | (2015.01) |

(52) U.S. Cl.

CPC ..... *A63B 69/3632* (2013.01); *A63B 60/12* (2015.10); *A63B 60/14* (2015.10)

(58) Field of Classification Search

CPC ..... A63B 69/3632; A63B 60/12; A63B 60/14; A63B 53/14; A63B 60/16

See application file for complete search history.

(56) References Cited

U.S. PATENT DOCUMENTS

| | | | | |
|---|---|---|---|---|
| 2,628,100 | A * | 2/1953 | Beebe | A63B 60/22 473/203 |
| 2,928,678 | A * | 3/1960 | Cutting | A63B 53/14 473/206 |
| 3,036,836 | A * | 5/1962 | Mason | A63B 53/14 473/206 |
| 3,256,023 | A * | 6/1966 | Frazelle | A63B 60/10 33/508 |
| 5,295,688 | A * | 3/1994 | Montgomery | A63B 69/3632 473/206 |
| 5,299,802 | A * | 4/1994 | Bouchet-Lassale | A63B 60/08 273/DIG. 30 |
| 7,927,236 | B2 * | 4/2011 | Brunton | A63B 69/3632 473/409 |
| 2009/0042660 | A1 * | 2/2009 | Shaw | A63B 60/00 473/203 |
| 2010/0151973 | A1 * | 6/2010 | Brunton | A63B 69/3685 473/409 |
| 2021/0228962 | A1 * | 7/2021 | Force | A63B 69/3632 |

* cited by examiner

*Primary Examiner* — Dylan C White
(74) *Attorney, Agent, or Firm* — Garson & Gutierrez, PC

(57) ABSTRACT

A golf club sleeve assembly as well as methods of its use. In one embodiment, the golf club sleeve assembly includes a grip sleeve having a hollow conical structure and a plurality of teeth positioned on an external surface of the grip sleeve. The golf club sleeve assembly further includes a right-hand grip having right-hand grip teeth positioned on an interior surface of the right-hand grip and a left-hand grip having left-hand grip teeth positioned on an interior surface of the left-hand grip. The teeth positioned on the external surface of the grip sleeve are configured to engage the right-hand grip teeth and the left-hand grip teeth to enable discrete rotation of both the right-hand grip and the left-hand grip.

20 Claims, 8 Drawing Sheets

GOLF CLUB SLEEVE ASSEMBLY AND METHODS OF USE

CROSS-REFERENCE TO RELATED APPLICATIONS

This application claims the benefit of priority to U.S. Provisional Patent Application Ser. No. 63/571,807 filed Mar. 29, 2024, of the same title, the contents of which being incorporated herein by reference in its entirety.

TECHNOLOGICAL FIELD

The present disclosure relates generally to golf aids, and more particularly in one exemplary aspect to a golf sleeve assembly that assists a golfer in hitting neutral straight shots, draw or hook shots, and fade or slice shots.

BACKGROUND

One of the biggest differentiators between a decent golfer and an expert golfer is the ability to work the ball left or right (or even straight) on command. For a right-handed golfer, the ability to work the ball right-to-left is known as a draw, while the ability to work the ball left-to-right is known as a fade. Conversely for a left-handed golfer, the ability to work the ball right-to-left is known as a fade, while the ability to work the ball left-to-right is known as a draw. Despite the commonality in terminology, the methods by which professional golf association ("PGA") teaching professionals teach golfers how to hit draws and fades can vary substantially.

One such methodology for teaching golfers how to work the ball either right-to-left or left-to-right involves placing the ball in your stance at varying positions. For example, if a golfer knows where to place the ball in their stance to hit a straight shot, placing the ball more back in your stance results in the club face being slightly more open on the way through impact thereby causing the ball to tend to fade. When executing a fade, a right-handed golfer, for example, will tend to aim left of target with the resulting fade moving from left to right, while left-handed golfers will tend to aim right of target with the resulting fade moving from right to left. Conversely, placing the ball more forward in your stance results in the club face being slightly more closed on the way through impact thereby causing the ball to tend to draw. However, such a methodology often feels unnatural to golfers, thereby requiring years for an average golfer to perfect, if ever.

Another methodology for teaching golfers how to work the ball (i.e., draw or fade the golf ball), involves the manipulation of the club face prior to and during the striking of the golf ball. For example, to hit a draw (for a right-handed golfer), the stance of the golfer needs to start to the right of the intended target where the golf ball will move right-to-left (and vice versa for left-handed golfers). However, despite the altered line of address, the golf club face will remain positioned towards the target prior to and during the striking of the golf ball. Accordingly, by swinging the golf club along the altered line, the ball will naturally move from right-to-left for a right-handed golfer (left-to-right for a left-handed golfer) with the goal being that the ball ends up at the target. The same general concept applies to fades as well. For example, to hit a fade, the stance of the golfer needs to start to the left of the intended target where the golf ball will move left-to-right for a right-handed golfer, and right-to-left for a left-handed golfer. The golf club face will again remain positioned towards the target prior to and during the striking of the golf ball. Accordingly, by swinging the golf club along the altered line, the ball will naturally move from left-to-right with the goal being that the ball ends up at the target. However again, such a methodology often feels unnatural to golfers, thereby again requiring years for an average golfer to perfect, if ever.

However, despite these various techniques for teaching a golfer how to shape their shots, there remains a need for golfing aids that provide proprioceptive, audio, and/or visual feedback to the user of the golfing aid to assist with the training of the golfer to shape their golf shots in a way that feels more natural. Ideally, such a golfing aid will also teach a golfer how to shape their shots, through muscle memory, in the absence of the golfing aid to enable the golfer to use the knowledge gained through use of the training aid in, for example, golf tournaments where these golfing aids are otherwise not allowed.

SUMMARY

The present disclosure satisfies the foregoing needs by providing, inter alia, a golf training aid that addresses some or all of the deficiencies recognized above.

In one aspect, a golf sleeve assembly is disclosed. In one embodiment, the golf club sleeve assembly includes a grip sleeve having a hollow conical structure and a plurality of teeth positioned on an external surface of the grip sleeve. The golf club sleeve assembly further includes a right-hand grip having right-hand grip teeth positioned on an interior surface of the right-hand grip and a left-hand grip having left-hand grip teeth positioned on an interior surface of the left-hand grip. The teeth positioned on the external surface of the grip sleeve are configured to engage the right-hand grip teeth and the left-hand grip teeth to enable discrete rotation of both the right-hand grip and the left-hand grip.

In another aspect, methods of using the aforementioned golf sleeve assembly are disclosed. In one embodiment, a method of using a golf sleeve assembly to determine placement of alignment marks disposed on a golf club and a golf glove is disclosed. The method includes rotating the sleeve assembly to determine a neutral hand position; marking the golf club and the golf glove based on the determined neutral hand position; rotating the sleeve assembly to determine a strong hand position; marking the golf club and the golf glove based on the determined strong hand position; rotating the sleeve assembly to determine a weak hand position; and marking the golf club and the golf club based on the determined weak hand position.

Other features and advantages of the present disclosure will immediately be recognized by persons of ordinary skill in the art with reference to the attached drawings and detailed description of exemplary implementations as given below.

BRIEF DESCRIPTION OF DRAWINGS

The features, objectives, and advantages of the present disclosure will become more apparent from the detailed description set forth below when taken in conjunction with the drawings, wherein.

DETAILED DESCRIPTION

Detailed descriptions of the various embodiments and variants of the apparatus and methods of the present disclosure are now provided. It is noted that wherever practicable similar or like reference numbers may be used in the figures and may indicate similar or like functionality. The figures depict embodiments of a sleeve assembly for use as a training aid for golf clubs, or methods of use for purposes of illustration only. One skilled in the art will readily recognize from the following description that alternative embodiments of the structures and methods illustrated herein may be employed without necessarily departing from the principles described herein.

Exemplary Grip Sleeve and Sleeve Assemblies

Figure 1A:
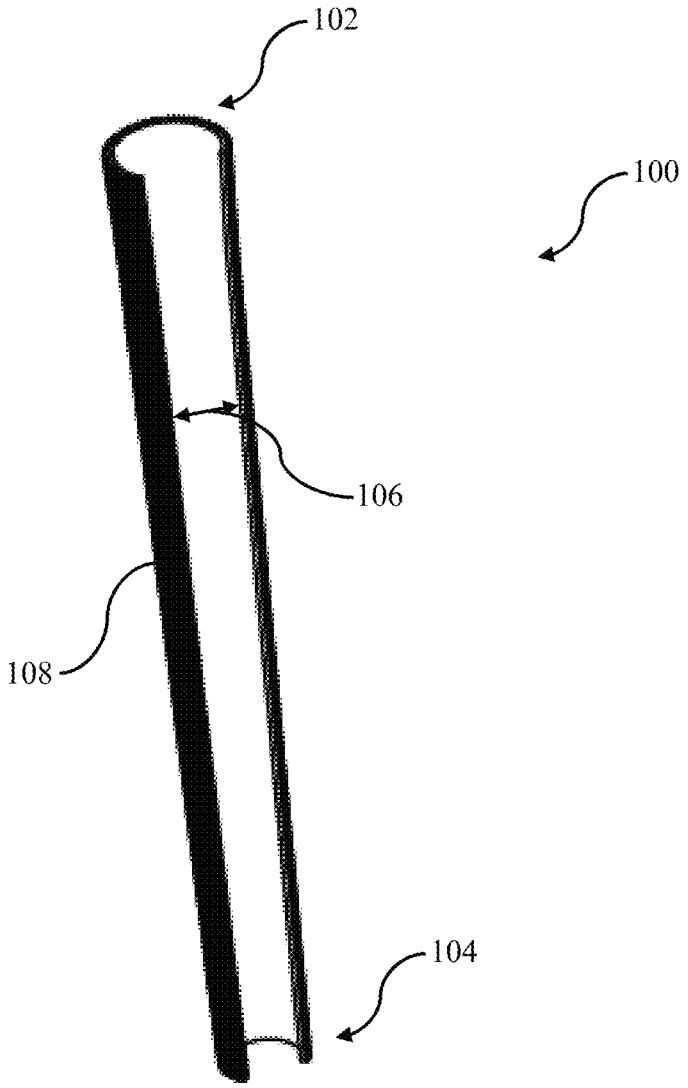
FIG. 1A is perspective view of a grip sleeve in accordance with the principles of the present disclosure.

Referring now to FIG. 1A, a perspective view of an exemplary grip sleeve 100 is shown and described in detail. As shown in FIG. 1A, the grip sleeve 100 may generally have a conical shape (e.g., tapered shape) with a hollow center. The conical shape of the grip sleeve 100 is defined by the smaller diameter end 104 where the diameter of the grip sleeve 100 gradually becomes larger until it ends at the larger diameter end 102. In some implementations, the grip sleeve 100 may include a gap 106 which enables the grip sleeve 100 to be placed onto (or taken off) differing golf clubs 200 such as irons, hybrids, woods, drivers, and/or putters. The precise sizing of the gap 106 may vary in size dependent upon, for example, the size of the grips (OEM or otherwise) on the golf club in which the training aid is to be affixed to.

In some implementations, the grip sleeve 100 may take the form of a standard golf grip that incorporates, for example, the teeth 108 as discussed in additional detail infra. In such an implementation, the grip sleeve 100 may be manufactured without a gap 106. Such an implementation may be desirable if, for example, the grip sleeve 100 is intended to be permanently (or semi-permanently) mounted onto a golf club 200. The diameter of the grip sleeve 100 may be sized to enable the grip sleeve 100 to be accommodated over an existing golf club grip 210 of a golf club 200 in some implementations. In other implementations, the diameter of the grip sleeve 100 may be sized to have a smaller diameter as compared with variants in which the grip sleeve 100 is intended to fit over an existing golf club grip 210 of a golf club 200. In such an implementation, the grip sleeve 100 may be intended for use directly on the golf club shaft 220 of a golf club 200. In yet another implementation, the grip sleeve 100 may be tapered in an inverse fashion as shown in FIG. 1A (i.e., with the smaller diameter end 104 and the larger diameter end 102 being reversed). In yet other implementations, the grip sleeve 100 may not have a smaller diameter end 104 or a larger diameter end 102 such that the grip sleeve 100 is of relatively consistent diameter throughout the length of the grip sleeve 100. These and other variants would be readily apparent to one of ordinary skill given the contents of the present disclosure and the specific geometries of the golf club 200 that the grip sleeve 100 is intended to be mounted to.

The exterior surface of the grip sleeve may include a plurality of teeth 108 with each of these teeth 108 running from one end of the grip sleeve 100 towards the other end of the grip sleeve 100 (e.g., from the smaller diameter end 104 of the grip sleeve 100 towards the larger diameter end 102 of the grip sleeve 100 dependent upon, for example, the grip sleeve 100 geometry). In some implementations, the teeth 108 may only run partially along the length of the grip sleeve 100. For example, the teeth 108 may start and/or end between, for example, the smaller diameter end 104 and/or the larger diameter end 102 of the grip sleeve 100. As but another non-limiting example, the teeth 108 may be dispersed along the length of the grip sleeve 100 in separate and distinct teeth containing and non-teeth containing groups to, for example, adjust the amount of force required to rotate the grips (112, 114, FIGS. 2A-2E) about the grip sleeve 100.

In some implementations, the grip sleeve 100 may be manufactured from a polymer or rubber-like material. The polymer material may be, for example, an injection-molded polymer material. In other implementations, the grip sleeve 100 may be manufactured from a 3-D printable material. The grip sleeve 100 may also be manufactured from a metal material in some implementations. Metal materials may be desirable in some instances, for example, in which the thickness of the material for the grip sleeve 100 is intended to be minimized as compared with, for example, polymer-based materials. These and other variations would be readily apparent to one of ordinary skill given the contents of the present disclosure.

Figure 1B:
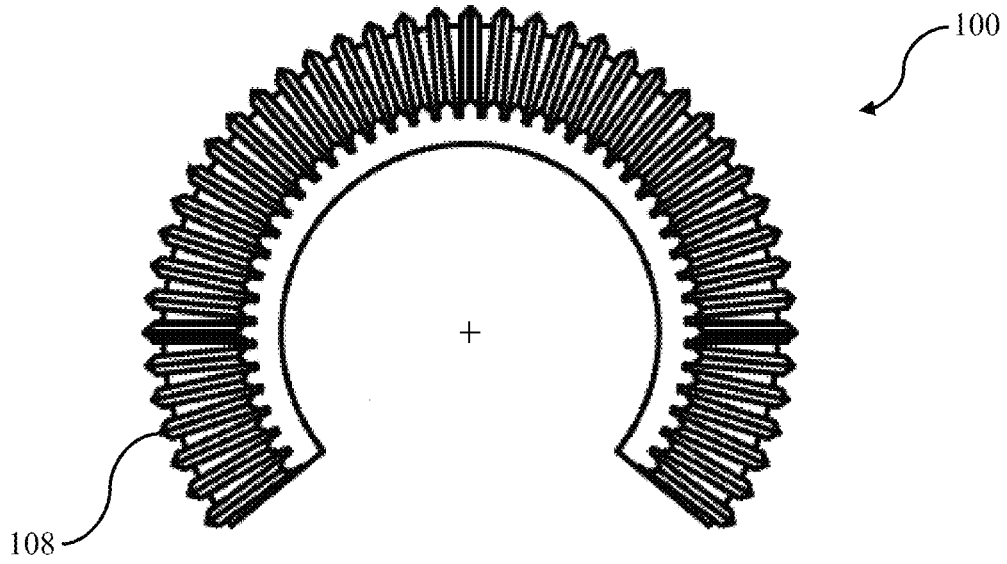
FIG. 1B is a front plan view of the grip sleeve of FIG. 1A of the smaller diameter end of the grip sleeve in accordance with the principles of the present disclosure.
Figure 1C:
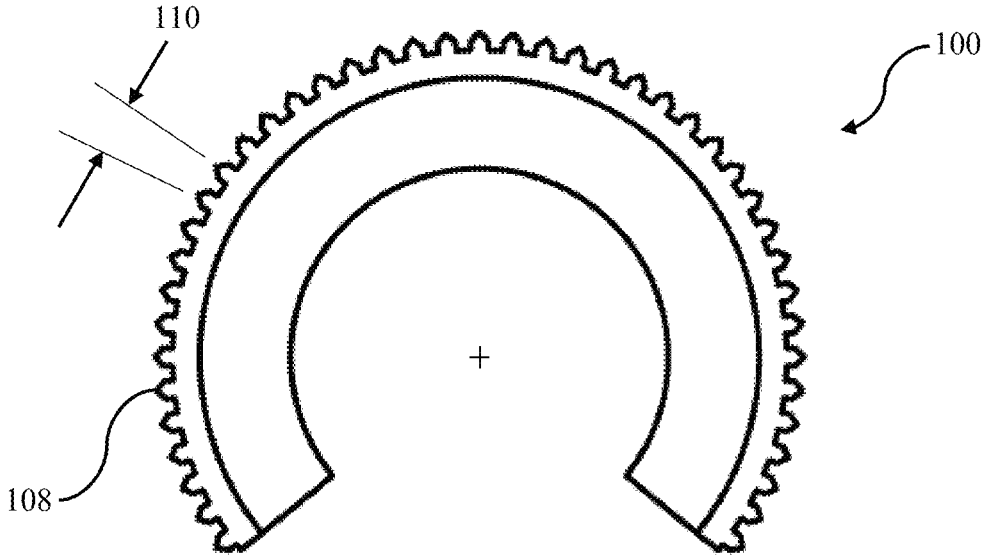
FIG. 1C is a back plan view of the grip sleeve of FIG. 1A of the larger diameter end of the grip sleeve in accordance with the principles of the present disclosure.

Referring now to FIGS. 1B and 1C, the teeth 108 on the grip sleeve 100 can be readily seen. As can be seen in FIG. 1C, the teeth 108 on the grip sleeve 100 may be separated by a defined angular separation 110. For example, in some implementations the number of teeth 108 is forty-three (43) and the angular separation 100 between individual teeth 108 is approximately six degrees) (6°. The number and/or angular separation 110 of the teeth 108 may be dependent upon, for example, the type of material the grip sleeve 100 is manufactured from. For example, the angular separation 100 of the teeth 108 may be smaller for grip sleeves 100 manufactured from a metal material as compared with grip sleeves 100 manufactured from polymer-based materials. Grip sleeves 100 with a smaller angular separation 110 between teeth 108 may be desirable as the ability to shape a golf shot to varying degrees may be increased with a smaller angular separation 110 as compared with a golf sleeve 100 that has a larger angular separation 110 between its teeth 108. As shown, the teeth 108 surround the entire periphery of the exterior surface of the grip sleeve 100. However, in some implementations, it may be desirable to only have teeth 108 on a subset of the external surface of the grip sleeve 100 (e.g., the teeth 108 may be positioned on those portions of the grip sleeve 100 in which manipulation of hand position is desired as will be described in additional detail infra).

As illustrated in FIG. 1C, the shape of the teeth 108 may have a "house-like" profile. In other words, each tooth 108 may consist of two surfaces that protrude generally from and perpendicular to the exterior surface of the grip sleeve 100 followed by two additional surfaces that are angled to meet one another thereby resembling a house-like profile. In some implementations, the two angled surfaces for the teeth 108 may protrude directly from the exterior surface of the grip sleeve 100 (i.e., without the two surfaces that protrude generally perpendicular to the exterior surface of the grip sleeve 100). In some variants, the profile of individual ones of the teeth 108 may have two (2) or more distinct surfaces. In other variants, the profile of individual ones of the teeth 108 may include a rounded profile (e.g., circular or oval) that may or may not be disposed on top of surfaces that protrude perpendicular to the exterior surface of the grip sleeve 100. In yet other variants, the teeth 108 may consist of discrete bumps (whether angular and/or round in profile). These and other variations would be readily apparent to one of ordinary skill given the contents of the present disclosure. The mechanism by which the golf sleeve 100 may assist a golfer in shaping their golf shot will be described below with reference to FIGS. 2A-3.

Figure 2A:
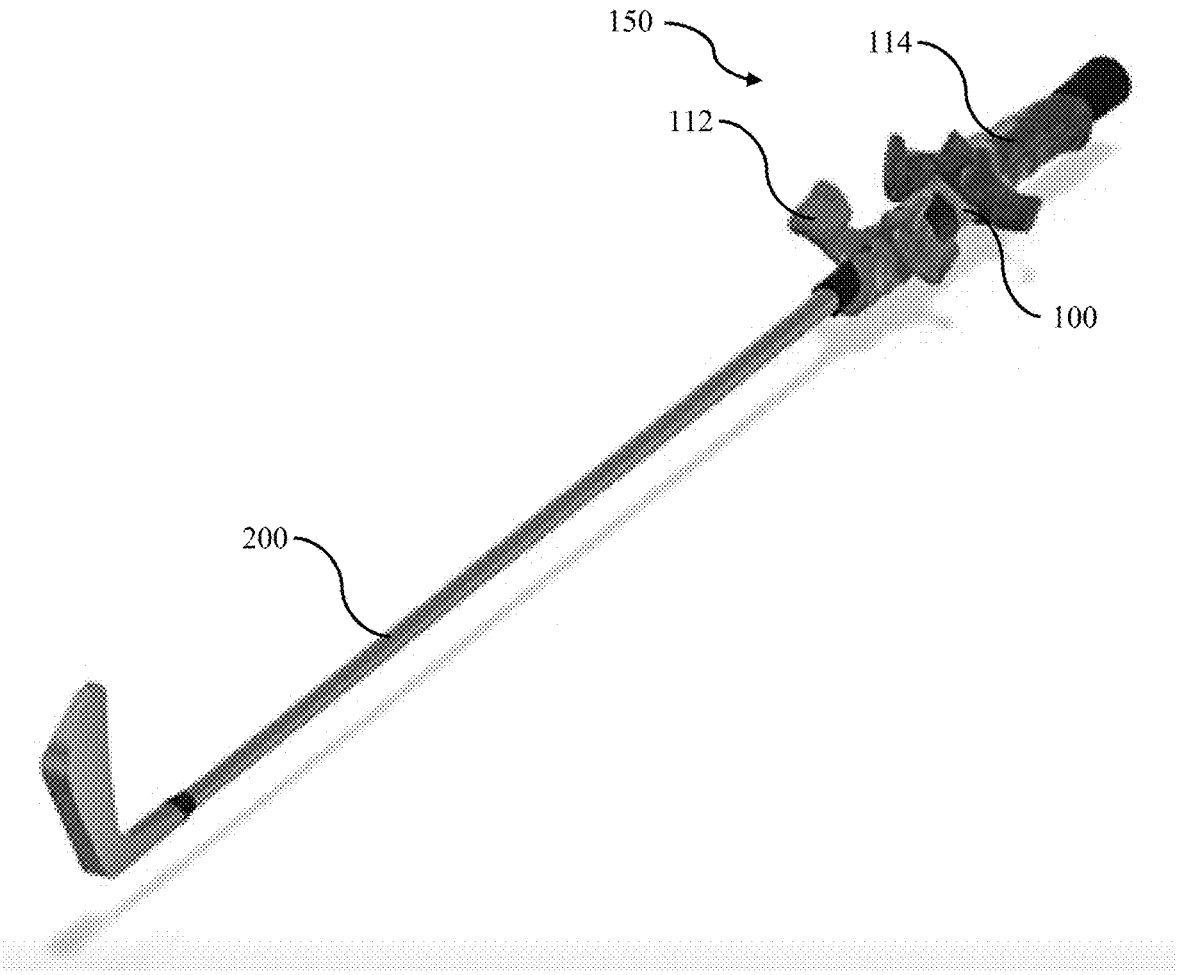
FIG. 2A is a perspective view of a golf club with the sleeve assembly mounted thereon in accordance with the principles of the present disclosure.
Figure 2B:
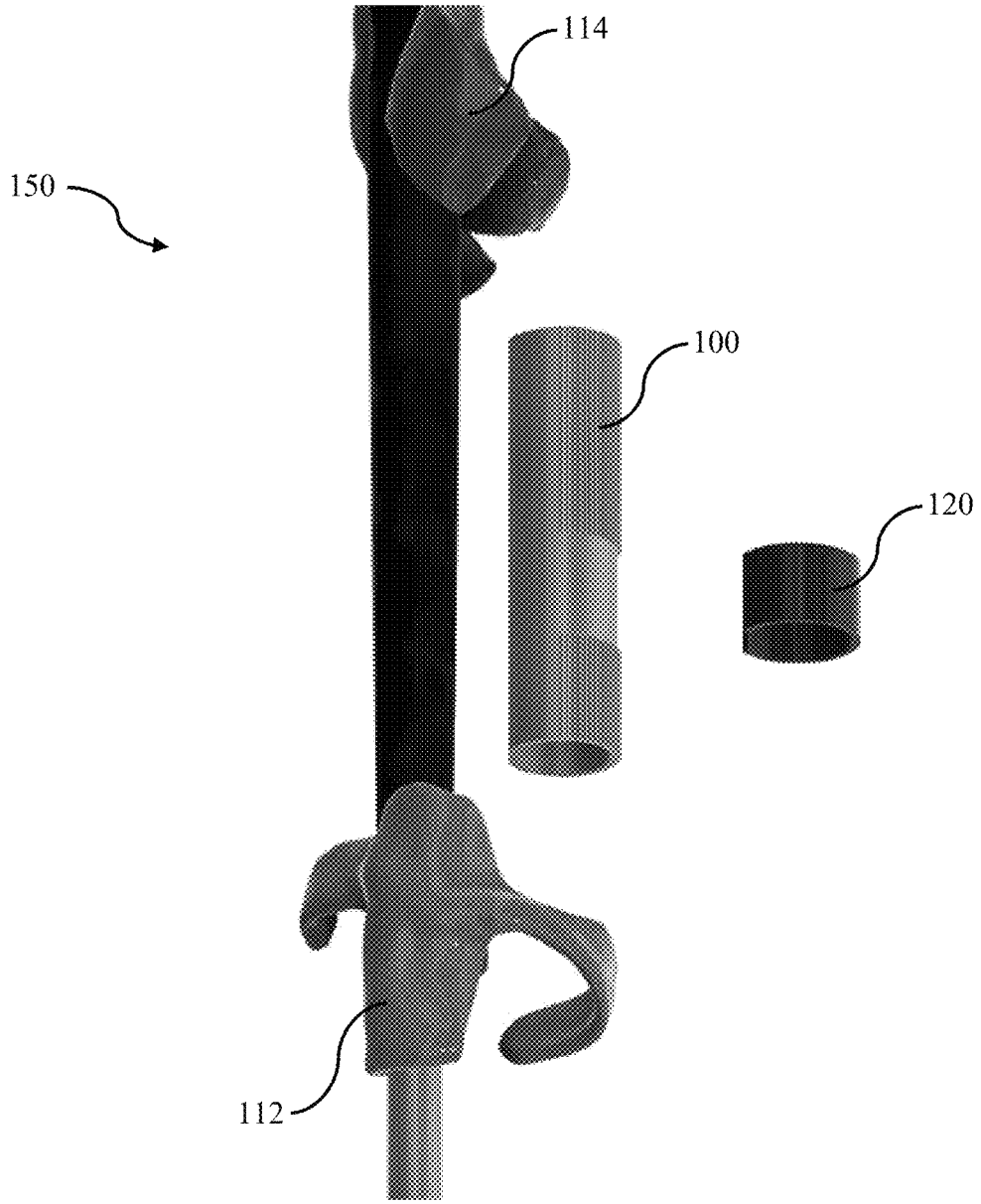
FIG. 2B is an exploded view of the sleeve assembly of FIG. 2A in accordance with the principles of the present disclosure.

Referring now to FIGS. 2A-2E, various illustrations of a sleeve assembly 150 positioned on or around a golf club 200 are shown. As shown in FIG. 2A, the sleeve assembly 150 consists of a right-hand grip 112, a left-hand grip 114, as well as the aforementioned grip sleeve 100. As shown in FIG. 2A, the right-hand grip 112 is positioned closer to the club face of the golf club 200 as compared to the left-hand grip 114. Such a set up is intended for use with right-handed golfers. However, in some implementations, the positioning of these two grips 112, 114 may be reversed for their use with left-handed golfers. FIG. 2B illustrates an exemplary variant exploded view of the sleeve assembly 150. As shown in FIG. 2B, the sleeve assembly 150 may consist of the aforementioned grip sleeve 100, a compression sleeve 120, a right-hand grip 112, and a left-hand grip 114. As illustrated, a portion of the grip sleeve 100 may not include the aforementioned teeth 108. This portion of the grip sleeve 100 without the aforementioned teeth 108 may be for accommodating the compression sleeve 120. The compression sleeve 120 may assist with applying additional pressure between the grip sleeve 100 and either or both of the golf club grip 210 and/or golf club shaft 220. In some implementations, the compression sleeve 120 may consist of, for example, a worm-drive hose clamp (or hose clamp with a tightening mechanism different from a worm-drive). The use of a worm-drive hose clamp may be desirable as it enables a user to increase the amount of tension between the grip sleeve 100 and one or both of the golf club grip 210 and golf club shaft 220 as compared with the C-shaped compression sleeve 120 illustrated in FIG. 2B. Use of the compression sleeve 120 with the grip sleeve 100 may be optional in some variants (e.g., in variants in which the additional pressure provided by the compression sleeve 120 is not required). These and other variants would be readily appreciated by one of ordinary skill given the contents of the present disclosure.

Figure 2C:
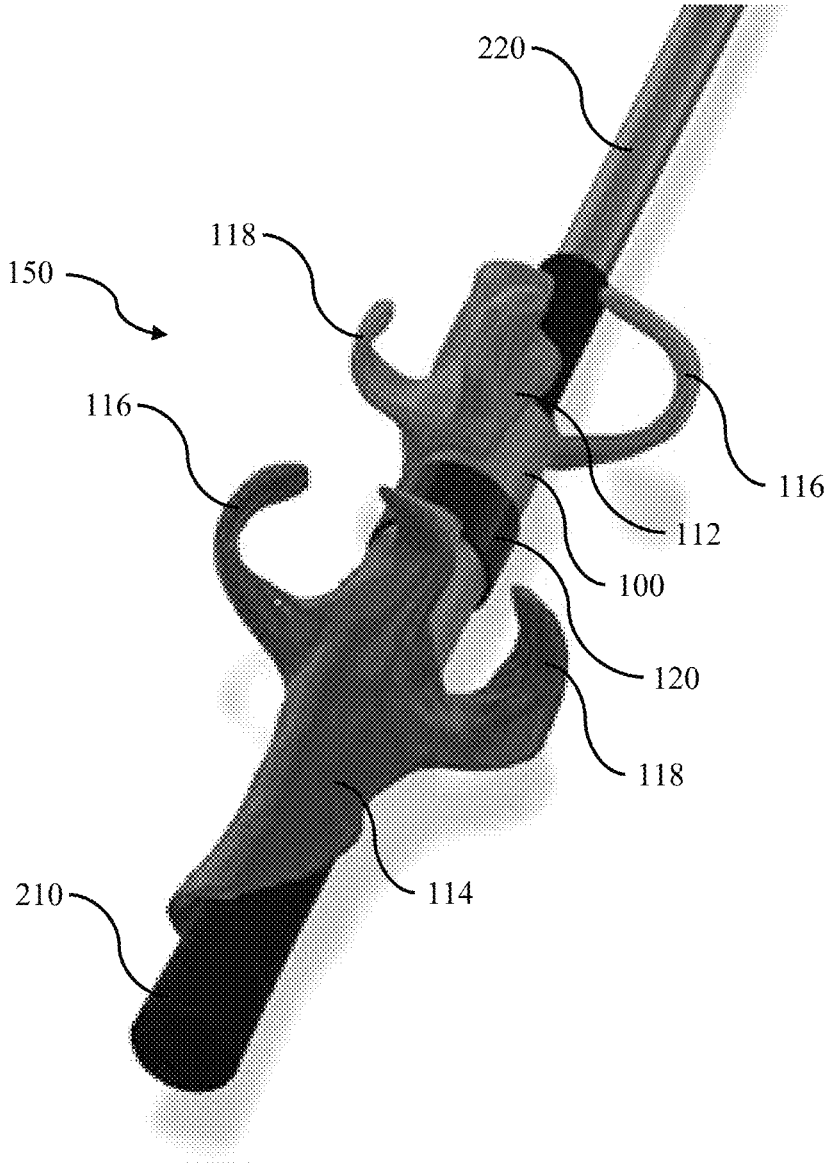
FIG. 2C is a perspective view of the sleeve assembly of FIG. 2A in accordance with the principles of the present disclosure.

Referring now to FIG. 2C, various features of the right-hand grip 112 and the left-hand grip 114 are shown and described in detail. As shown in FIG. 2C, the left-hand grip 114 includes both an index finger slot 116 as well as a thumb slot 118. Similarly, the right-hand grip 112 also includes an index finger slot 116 as well as a thumb slot 118, albeit reversed from the left-hand grip 114. The purpose of the index finger slot 116 and thumb slot 118 is to provide proprioceptive, visual, and/or non-movable static input for the hand of the user of the sleeve assembly 150. In other words, these slots 116, 118 enable a user of the sleeve assembly 150 to properly position their hands around the grip 210 of the golf club 200. In some implementations, the use of these slots 116, 118 may be obviated and simpler grip 112, 114 geometries may be utilized. The interior surface of the right-hand grip 112 and the left-hand grip 114 include teeth that are similar to the teeth 108 illustrated on the grip sleeve 100. The teeth on the right-hand grip 112 and the left-hand grip 114 enable these grips 112, 114 to be rotated around the grip sleeve 100. These two sets of teeth (i.e., between the right-hand grip 112/left-hand grip 114 and the grip sleeve 100) enable the user of the sleeve assembly 150 to, for example, "click" between various hand positions with respect to the golf club face as illustrated in FIGS. 2D and 2E.

Figure 2D:
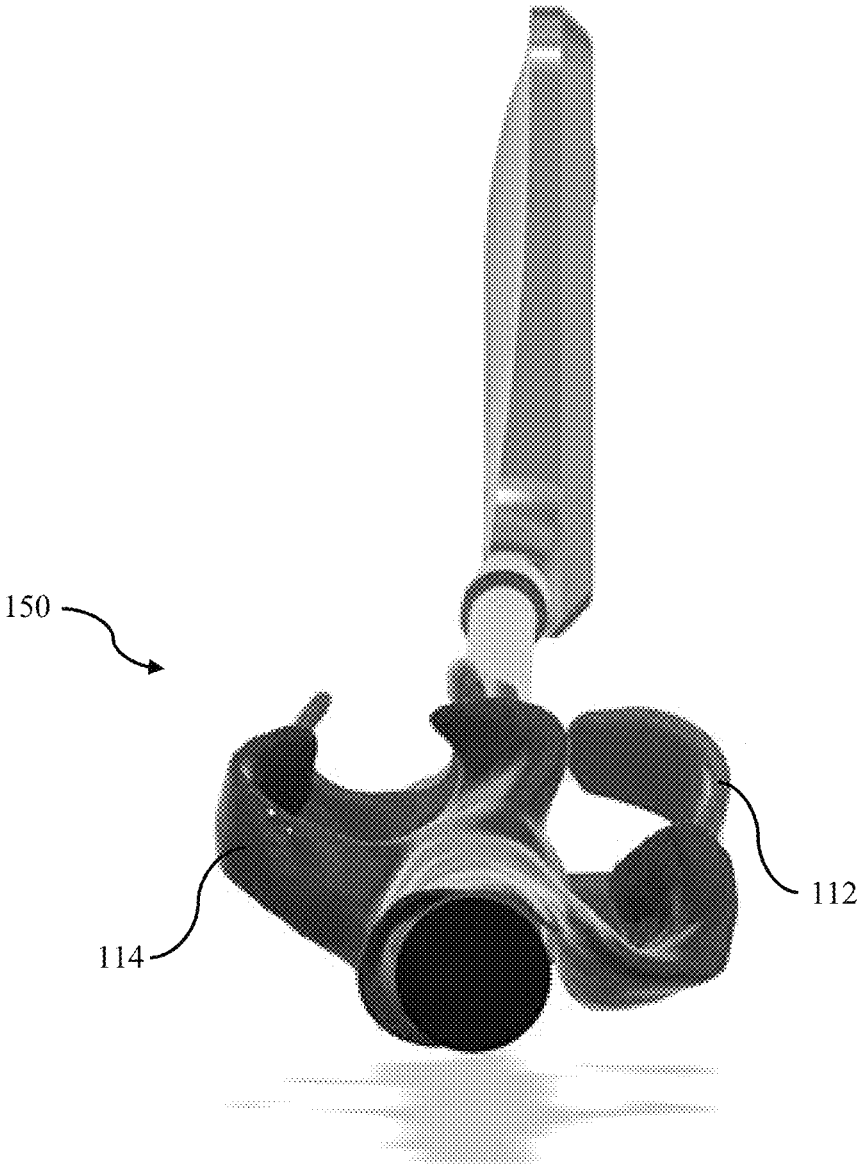
FIG. 2D is a front plan view of the sleeve assembly of FIG. 2A in a first orientation in accordance with the principles of the present disclosure.
Figure 2E:
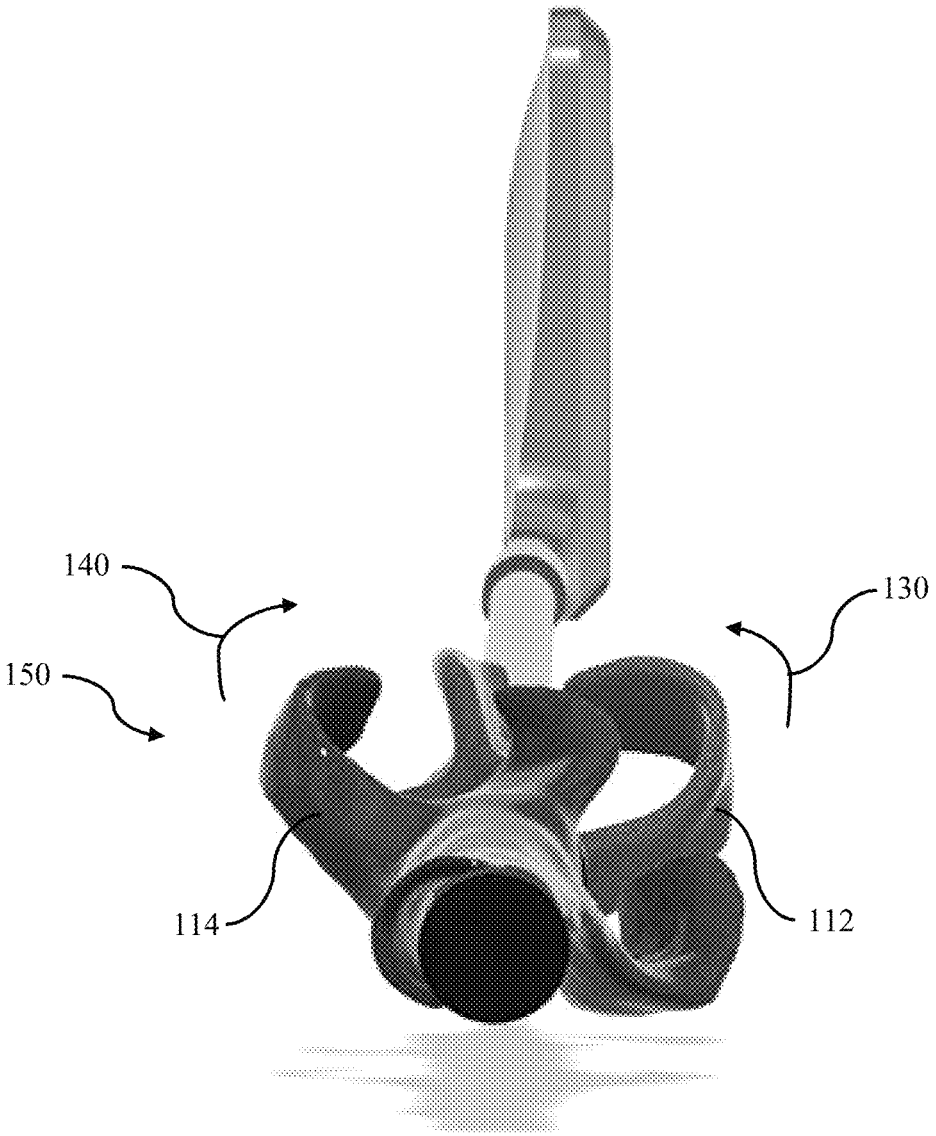
FIG. 2E is a front plan view of the sleeve assembly of FIG. 2A in a second orientation in accordance with the principles of the present disclosure.

Referring now to FIGS. 2D and 2E, the usefulness of being able to click between various hand positions is shown and described in detail. For example, FIG. 2D illustrates the right-hand grip 112 and the left-hand grip 114 positioned in a neutral hand position. As a brief aside, contrary to accepted wisdom, the neutral hand position for a golfer varies from golfer to golfer. For example, a so-called strong hand position for one golfer may be a neutral hand position for another golfer. Similarly, a weak hand position for one golfer may be a neutral hand position for another golfer. In yet another example, a strong hand position for one golfer may be a weak hand position for another golfer. The determination of a neutral hand position may be determined by rotating the right-hand grip 112 and the left-hand grip 114 amongst varying positions to determine a hand position that enables a golfer to hit the golf ball straight. Alternatively, the neutral hand position for a given golfer may be determined through the assistance of a PGA teaching professional.

Referring now to FIG. 2E, the right-hand grip 112 has been rotated counterclockwise 130 from the position of the right-hand grip 112 as compared with the position of the right-hand grip 112 illustrated in FIG. 2D. Conversely, the left-hand grip 114 has been rotated clockwise 140 from the position of the left-hand grip 114 illustrated in FIG. 2D. Alternatively, both the right-hand grip 112 and the left-hand grip 114 may move in the same direction. For example, if both the right-hand grip 112 and the left-hand grip 114 rotate counterclockwise 130 from the position shown in FIG. 2D, such hand positioning will result in a so-called weak hand position. Conversely, if both the right-hand grip 112 and the left-hand grip 114 rotate clockwise from the position shown in FIG. 2D, such hand positioning will result in a so-called strong hand position. Depending upon the hand position chosen, the golfer will then be able to shape their shots either from right-to-left (a draw for a right-handed golfer) or from left-to-right (a fade for a right-handed golfer). Accordingly, through use of the sleeve assembly 150, a golfer can teach themselves how to shape their golf shots.

As a brief aside, the use of the sleeve assembly 150 may not be intended for use in tournament conditions. However, by using the sleeve assembly 150, a golfer may determine what hand position(s) work best for the intended shaped golf shot. Accordingly, by using the sleeve assembly 150, a golfer may place alignment aids on either or both the golf club 200 (e.g., lines drawn down the golf club shaft 220 and/or the golf club head) as well as on the glove of the golfer. Accordingly, through use of the sleeve assembly 150 in training a golfer to shape their shots and determining the position of these alignment aids placed on their golf club 200 and/or golf glove, a golfer is then able to use these alignment aids in, for example, tournament conditions to assist them in shaping their shots. These alignment aids may consist of, for example, markings using an ink pen, stickers, embroidering and the like on both the golf club 200 and/or the golf glove. In some implementations, markings on the golf glove may not be necessary as use of the sleeve assembly 150 may provide enough muscle memory and visual cues to be utilized without either the sleeve assembly 150 or markings on the golf glove.

Figure 3:
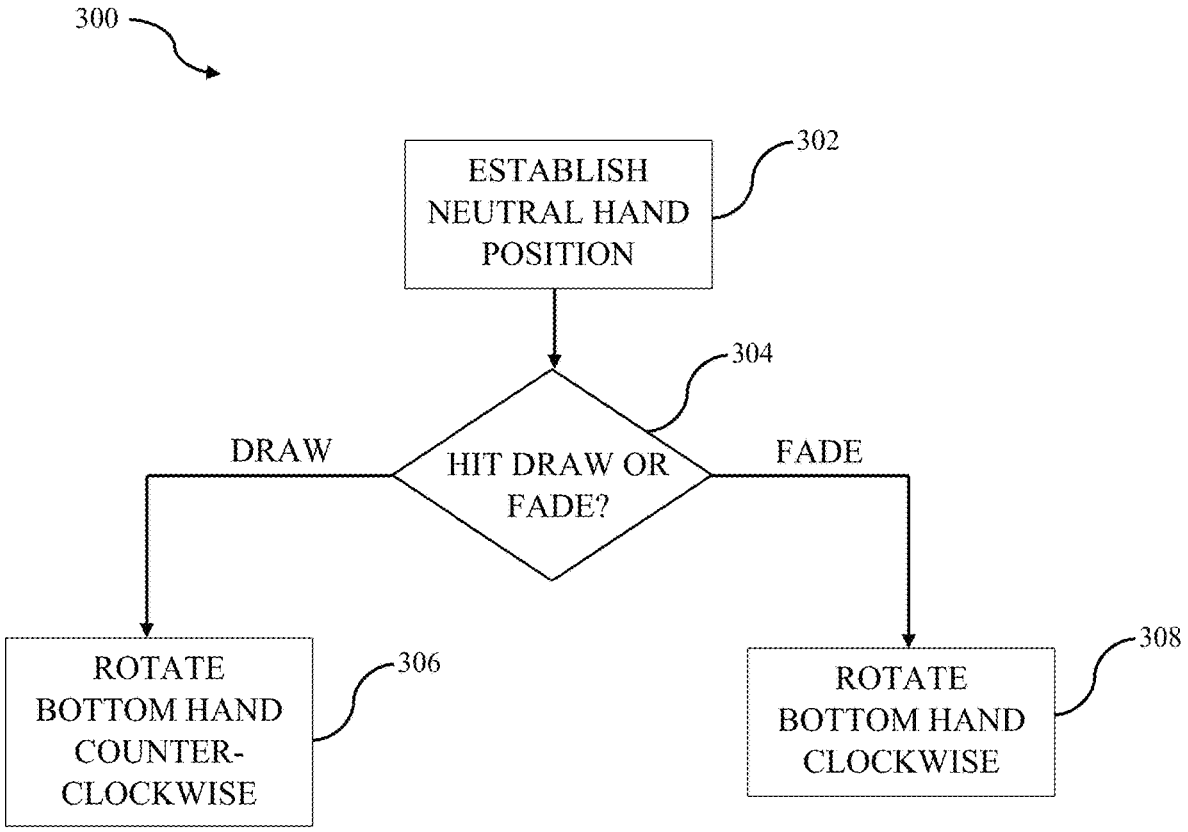
FIG. 3 is a logical flow diagram for an exemplary usage case for the sleeve assembly of FIGS. 2A-2E in accordance with the principles of the present disclosure.

Referring now to FIG. 3, one exemplary methodology 300 for using the sleeve assembly 150 is shown and described in detail. At step 302, a right-handed golfer will establish their neutral hand position. As described previously, this neutral hand position may be determined through trial-and-error and/or may be determined using a teaching professional's guidance. At step 304, the right-handed golfer will decide whether they wish to hit a draw or a fade with their next golf shot. If the right-handed golfer wishes to hit a draw, at step 306 the bottom hand (or both hands) is rotated counterclockwise from the neutral position previously established at step 302. Conversely, if the right-handed golfer wishes to hit a fade, at step 308 the bottom hand (or both hands) is rotated clockwise from the neutral position previously established at step 302. This methodology may be repeated for left-handed golfers by reversing steps 306 and 308 for hitting both the draw and fade.

It will be recognized that while certain aspects of the present disclosure are described in terms of specific design examples, these descriptions are only illustrative of the broader methods of the disclosure and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

The invention claimed is:

1. A sleeve assembly, comprising:

a grip sleeve comprising a hollow conical structure having a plurality of teeth positioned on an external surface of the grip sleeve;

a right-hand grip comprising right-hand grip teeth positioned on an interior surface of the right-hand grip; and a left-hand grip comprising left-hand grip teeth positioned on an interior surface of the left-hand grip;

wherein the plurality of teeth positioned on the external surface of the grip sleeve are configured to engage the right-hand grip teeth and the left-hand grip teeth to enable discrete rotation of both the right-hand grip and the left-hand grip.

2. The sleeve assembly of claim 1, wherein the grip sleeve comprises a first end and a second end, the first end comprising a larger diameter as compared with the second end of the grip sleeve.

3. The sleeve assembly of claim 2, wherein the plurality of teeth positioned on the external surface of the grip sleeve each run generally from the first end of the grip sleeve towards the second end of the grip sleeve.

4. The sleeve assembly of claim 1, wherein the plurality of teeth positioned on the external surface of the grip sleeve only runs a long a portion of a length of the grip sleeve.

5. The sleeve assembly of claim 4, wherein the length of the grip sleeve comprises both teeth containing and non-teeth containing groups along the external surface of the grip sleeve.

6. The sleeve assembly of claim 1, wherein each of the plurality of teeth positioned on the external surface of the grip sleeve comprises a house-like profile.

7. The sleeve assembly of claim 6, wherein the right-hand grip teeth positioned on the interior surface of the right-hand grip each comprise a house-like profile.

8. The sleeve assembly of claim 7, wherein the left-hand grip teeth positioned on the interior surface of the left-hand grip each comprise a house-like profile.

9. The sleeve assembly of claim 8, wherein the plurality of teeth positioned on the external surface of the grip sleeve and the right-hand grip teeth positioned on the interior surface of the right-hand grip produce an audible sound during the discrete rotation of the right-hand grip.

10. The sleeve assembly of claim 8, wherein the plurality of teeth positioned on the external surface of the grip sleeve and the left-hand grip teeth positioned on the interior surface of the left-hand grip produce an audible sound during the discrete rotation of the left-hand grip.

11. The sleeve assembly of claim 1, wherein the hollow conical structure of the grip sleeve enables the grip sleeve to be positioned over a golf grip on a golf club.

12. The sleeve assembly of claim 1, wherein the hollow conical structure of the grip sleeve enables the grip sleeve to be positioned over a golf club shaft without an existing golf grip.

13. The sleeve assembly of claim 1, wherein the right-hand grip comprises both an index finger slot and a thumb slot, the index finger slot and the thumb slot providing proprioceptive, visual, and/or non-movable static input for a user of the sleeve assembly.

14. The sleeve assembly of claim 13, wherein the left-hand grip comprises both an index finger slot and a thumb slot, the index finger slot and the thumb slot providing proprioceptive, visual, and/or non-movable static input for the user of the sleeve assembly.

15. The sleeve assembly of claim 14, wherein the grip sleeve comprises a first end and a second end, the first end comprising a larger diameter as compared with the second end of the grip sleeve.

16. The sleeve assembly of claim 15, wherein the plurality of teeth positioned on the external surface of the grip sleeve each run over at least a portion of the grip sleeve from the first end of the grip sleeve towards the second end of the grip sleeve.

17. The sleeve assembly of claim 16, wherein the plurality of teeth positioned on the external surface of the grip sleeve and the right-hand grip teeth positioned on the interior surface of the right-hand grip produce an audible sound during the discrete rotation of the right-hand grip.

18. The sleeve assembly of claim 17, wherein the plurality of teeth positioned on the external surface of the grip sleeve and the left-hand grip teeth positioned on the interior surface of the left-hand grip produce an audible sound during the discrete rotation of the left-hand grip.

19. A method of using the sleeve assembly of claim 1 to determine placement of alignment marks disposed on a golf club and a golf glove, the method comprising:

rotating the sleeve assembly to determine a neutral hand position;

marking the golf club and the golf glove based on the determined neutral hand position;

rotating the sleeve assembly to determine a strong hand position;

marking the golf club and the golf glove based on the determined strong hand position;

rotating the sleeve assembly to determine a weak hand position; and marking the golf club and the golf club based on the determined weak hand position.

20. The method of claim 19, wherein the marking of the golf club and the golf glove comprises using an ink pen on the golf club and the golf glove.

* * * * *